United States Patent [19]

Breithaupt

[11] Patent Number: 4,513,552

[45] Date of Patent: Apr. 30, 1985

[54] SHEET ALUMINUM FIREPROOF CONSTRUCTION ELEMENT

[75] Inventor: Albert Breithaupt, Cologne, Fed. Rep. of Germany

[73] Assignee: Trube & Kings Kommanditgesellschaft, Cologne, Fed. Rep. of Germany

[21] Appl. No.: 555,432

[22] Filed: Nov. 25, 1983

Related U.S. Application Data

[63] Continuation of Ser. No. 241,381, Mar. 6, 1981, abandoned.

[30] Foreign Application Priority Data

Mar. 13, 1980 [DE] Fed. Rep. of Germany ..... 3009729

[51] Int. Cl.[3] ..... E04B 1/62

[52] U.S. Cl. ..... 52/400; 52/731; 52/781; 49/DIG. 1

[58] Field of Search ..... 52/171, 400

[56] References Cited

U.S. PATENT DOCUMENTS

| | | | |
|---|---|---|---|
| 2,322,700 | 6/1943 | Mussey | 189/46 |
| 2,654,451 | 10/1953 | Schmidgall | 52/475 |
| 3,282,007 | 11/1966 | Campbell et al. | 52/475 |
| 3,456,408 | 7/1969 | Zahn | 52/397 X |
| 4,040,219 | 8/1977 | Budich | 52/732 X |
| 4,045,930 | 9/1977 | Dixon | 52/232 |
| 4,096,678 | 6/1978 | Diels et al. | 52/731 X |
| 4,128,934 | 12/1978 | Doring | 49/DIG. 1 X |
| 4,185,439 | 1/1980 | Bischlipp et al. | 49/DIG. 1 X |
| 4,332,111 | 6/1982 | Terashima | 52/397 X |
| 4,424,653 | 1/1984 | Heinen | 52/232 X |

FOREIGN PATENT DOCUMENTS

| | | | |
|---|---|---|---|
| 657449 | 2/1963 | Canada | 49/DIG. 2 |
| 2654776 | 4/1978 | Fed. Rep. of Germany | 52/232 |
| 2821096 | 11/1979 | Fed. Rep. of Germany | 49/DIG. 2 |
| 2934129 | 3/1980 | Fed. Rep. of Germany | . |
| 2414612 | 9/1979 | France | 52/400 |

OTHER PUBLICATIONS

Page 38 of Bauplan.

*Primary Examiner*—Carl D. Friedman

*Attorney, Agent, or Firm*—Karl F. Ross; Herbert Dubno

[57] ABSTRACT

A fireproof building element comprises a panel of nonflammable nonmetallic material, specifically glass, surrounded by an at least partly metallic framework with legs of rectangular cross-section divided by the plane of a surface of the panel into two frame portions together defining a recess accommodating an edge of the panel. One or both frame portions form at least one chamber, externally bounded by sheet metal with a wall thickness of not less than one millimeter, adjacent an external face of the framework paralleling the panel. Except for certain intermediate sections at or near the plane of the panel, which may be made of nonmetallic material of heat-insulating character, the framework consists virtually in its entirety of aluminum. The legs of the framework may be laterally split into separably interfitting inner and outer frame members each formed with a pair of chambers on opposite sides of the dividing plane.

17 Claims, 42 Drawing Figures

SHEET ALUMINUM FIREPROOF CONSTRUCTION ELEMENT

This application is a continuation of application Ser. No. 241,381 filed Mar. 6, 1981 abandoned.

FIELD OF THE INVENTION

My present invention relates to a metallic construction element. More particularly this invention concerns such an element usable as a window frame or the like.

BACKGROUND OF THE INVENTION

A fireproof construction element of the type shown from German industrial standard (DIN)4102 is normally made of steel. Only steel has been found to have the necessary fire resistance. Although aluminum is well known for use in the window frames, it has been found unsuitable for use in firecode construction since it melts at approximately 659° C. This drawback of aluminum has been recognized as making it completely unsuitable for fireproof construction, in particular in window frames since the aluminum is said to soften and allow glass to drop out.

OBJECTS OF THE INVENTION

It is therefore an object of the present invention to provide an improved fireproof construction element.

Another object is to provide such an element which overcomes the disadvantages of the prior-art element.

SUMMARY OF THE INVENTION

These objects are attained according to the instant invention in a building element having a fireproof panel surrounded on four sides by a framework with legs of rectangular cross-section divided in the plane of a panel surface into two frame portions defining between them an inner recess to accommodate an edge of the panel. The framework consists at least partly of aluminum, especially along opposite faces paralleling the panel, and includes at least one chamber separated from one of these faces by a sheet-aluminum wall with a mininum thickness of 1.0 mm. Such a construction has been found to satisfy the above-given extremely rigorous industrial standard. Rather than melting, the framework retains its shape so as to prevent penetration by flames and gas. The framework includes one or more aluminum profiles which form the chamber or chambers and may support retainer strips of aluminum designed to hold the panel securely in place. All parts of the fireproof building element according to this invention are of the classes A1, A2 and B1 according to the above-mentioned German industrial standard 4102.

It is of importance that the at least partly metallic framework according to my invention should have a minimal heat-conducting and heat-storing capacity so that only a small amount of thermal energy is transmitted through it. This is best achieved by providing the framework leg with an aluminum core flanked by a pair of at least partially empty, longitudinally extending, laterally closed chambers respectively adjoining its aforementioned faces.

BRIEF DESCRIPTION OF THE DRAWING

The above and other features of my invention will now be described in detail with reference to the accompanying drawing in which.

Specific Description

Figure 1:
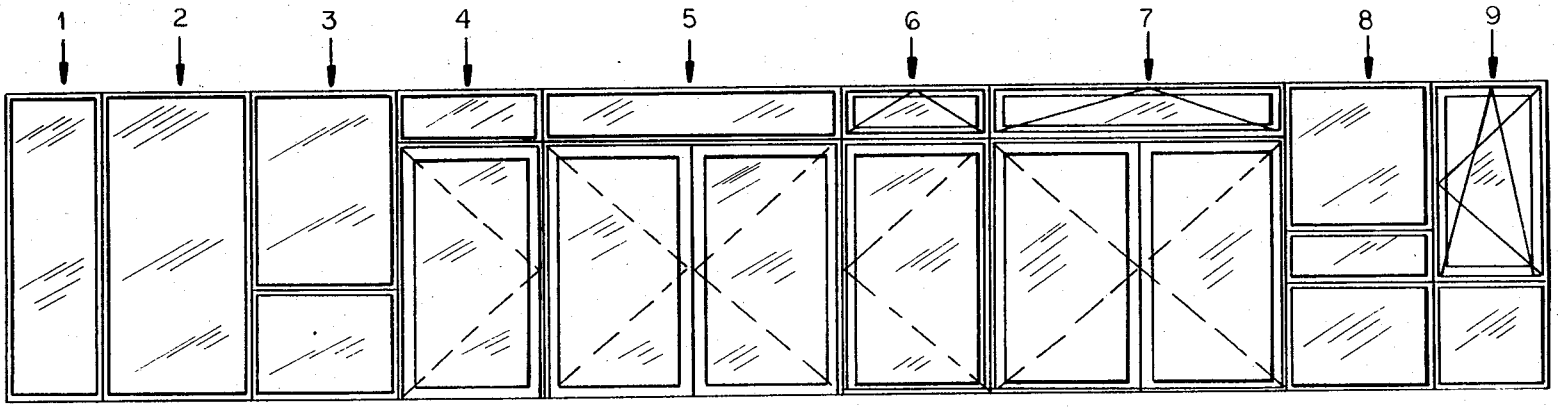
FIG. 1 is a side elevational view of a fireproof wall with a multiplicity of different building elements according to the instant invention.

FIG. 1 shows a wall formed of various types of panels individually surrounded by respective framworks according to this invention. At the far left there is a glazed fixed four-sided panel 1 followed by an opaque fixed panel 2. A unit 3 has a fixed glazed panel above a fixed opaque panel. A unit 4 has a fixed glazed panel above an openable door. A unit 5 has a fixed glazed opening above a double-door assembly. A unit 6 has an openable glazed transom above a single door. A unit 7 has an openable glazed transom above a double-door assembly. A unit 8 has a fixed glazed panel above an openable glazed panel also present in turn above an opaque panel. Finally a unit 9 has a so-called tip-or-swing window above a fixed glazed panel.

Figure 2A:
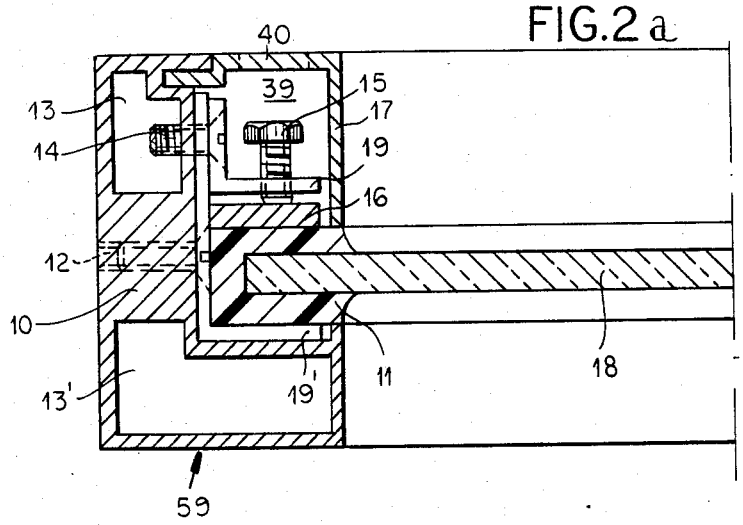
FIG. 2*a* is a cross-sectional view of a respresentative portion of one building element according to this invention.

Any of these fixed glazed panels is surrounded by a plurality of frame members constituting a framwork with legs of rectangular cross-section as illustrated in FIG. 2*a* for one such framework 59. The framework leg shown here comprises a solid longitudinally extending aluminum core 10 of rectangular section formed unitarily with and flanked by an inner chamber 13 and an outer chamber 13'. Both chambers 13 and 13' extend longitudinally over the full length of the core 10. The outer walls defining these chambers 13 and 13' are made of aluminum of a thickness of at least 1.0 mm. The outer chamber 13' is substantially wider than the inner chamber 13. A sheet of fireproof glass 18 of the type used in building-material classes A1 and A2 of DIN4102, part one, has a fireproof bead 11 surrounding its edge. The two frame portions on opposite sides of the plane of panel 18 respectively include two L-section retainer strips 19 and 19', defining between them a recess accommodating the bead 11, which are secured by screws 12 and 14 to a wall of the inner chamber 13 and bracket the edge of the glass panel between them. A holding strip 16 can be urged by means of a screw 15, threaded through the retainer strip 19 and accessible through a wall opening 40, against the elastomeric and fireproof bead 11 to hold the panel 18 snugly in place, in line with core 10 whose thickness exceeds that of the panel. An L-section cover strip 17 is snap-fitted to the frame member to cover the screws 14 and 15 and dresses the inside opening around the edge of the panel 18, thereby completing the rectangular cross-section of the framework leg. Thus the cover strip 17 defines a chamber 39 forming an extension of chamber 13 parallel to chamber 13', the three chambers being externally bounded by walls of sheet aluminum defining frame faces parallel to panel 18.

Figure 2B:
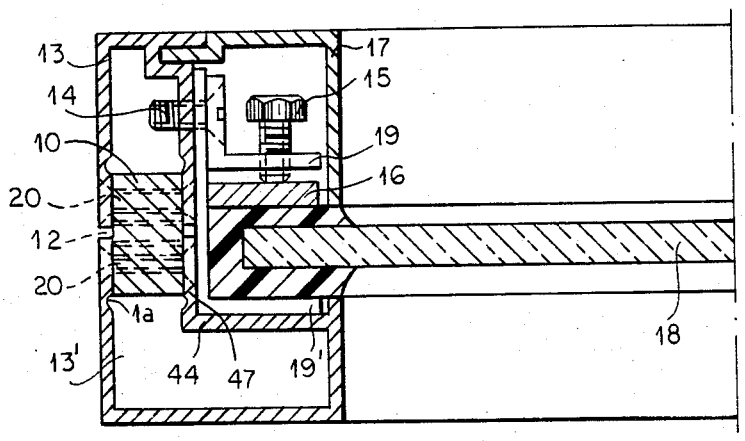
FIGS. 2*b* and 2*c* are views similar to FIG. 2*a*, showing modifications of the arrangement of FIG. 2*a;*

FIG. 2*b* shows a substantially identical arrangement, but wherein the chambers 13 and 13' are formed by separate elements secured to the core 10 by means of screws 20. The sheet-aluminum walls of these chambers are indented at 1*a* immediately adjacent the core 10 to reduce heat transmission to core 10.

Figure 2C:
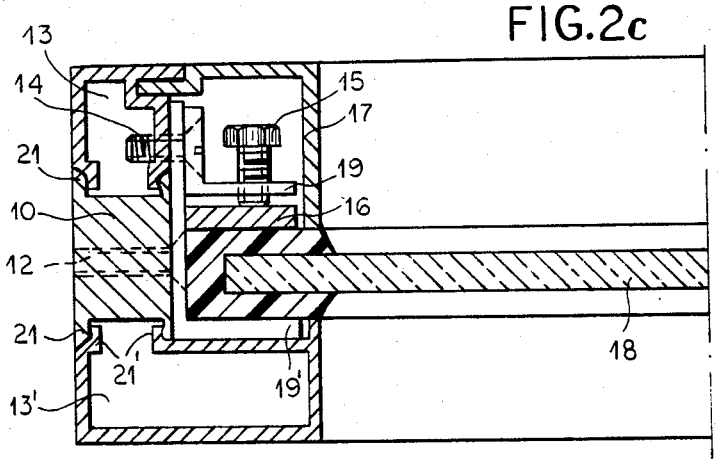

In FIG. 2*c* a substantially identical arrangement is shown, but wherein interengaging lips and grooves 21 and 21' are formed on the sheet-aluminum elements bounding the chambers 13 and 13' adjacent the core 10. Thus these elements can be snapped or slid together.

Figure 3A:
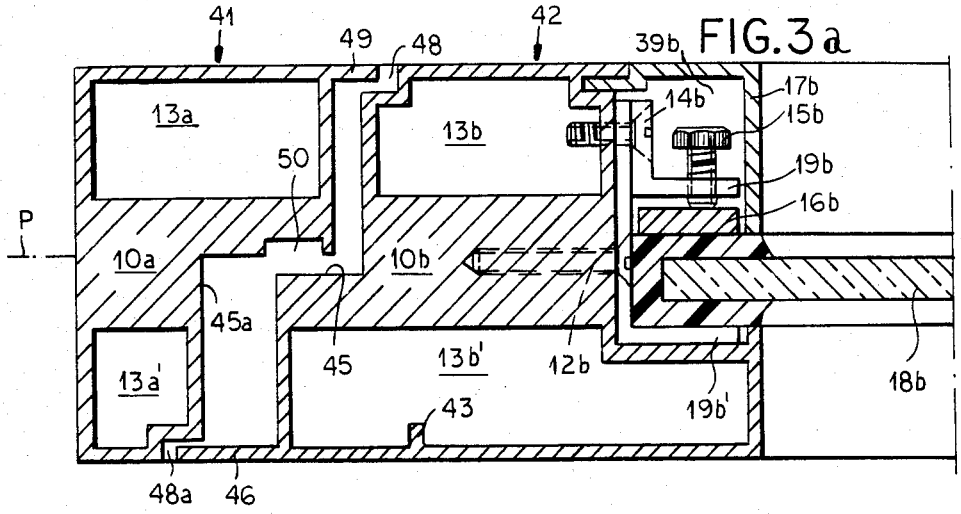
FIGS. 3*a*–3*c*, FIGS. 4*a*–4*c*, FIGS. 5*a*–5*c*, FIGS. 6*a*–6*c*, FIGS. 7*a*–7*c*, FIGS. 8*a*–8*c*, FIGS. 9*a*–9*c*, FIGS. 10*a*–10*c*, and FIGS. 11*a*–11*c* are views corresponding to FIGS. 2*a*–2*c*, respectively, showing further embodiments of my invention.

In FIG. 3*a* I have shown a laterally divided leg of a framework surrounding a panel 18*b*. Such a framework basically comprises a laterally outer frame member 41, adapted to be placed in the structure of the building to be fitted with the panel, and a laterally inner frame member 42 that is swingable (e.g. by means of hinges) relatively to the outer member 41. The outer member 41 is similar to part of the framework 59 of FIG. 2*a*, having a solid core 10*a* and chambers 13*a* and 13*a'*. The inner frame member 42 has a core 10*b* flanked by chambers 13*b* and 13*b'* and is provided with retainer strips 19*b* and 19*b'* as well as screws 14*b* and 15*b* and a cover strip 17*b* also like the member 59 in FIG. 2*a*. The two members 41 and 42 complement each other to a framework leg of rectangular cross-section in the illustrated alignment position in which their surfaces parallel to panel 18*b* are coplanar.

The outer frame member 41 is formed on one side of its central plane P with a lip 49 and on its other side with a cutout 48*a*. The inner frame member 42 is complementarily formed on one side of the plane P with a cutout or step 48 receiving the lip 49 and with a lip 46 received in the step 48*a*. The confronting faces 45 and 45*a* of these members 41 and 42 are also stepped, and face 45*a* is formed with a longitudinally extending groove 50. The walls forming the recesses 13*a* 13*a'*, 13*b*, 13*b'* may be provided with stiffening ribs 43 extending inwardly.

Figure 3B:
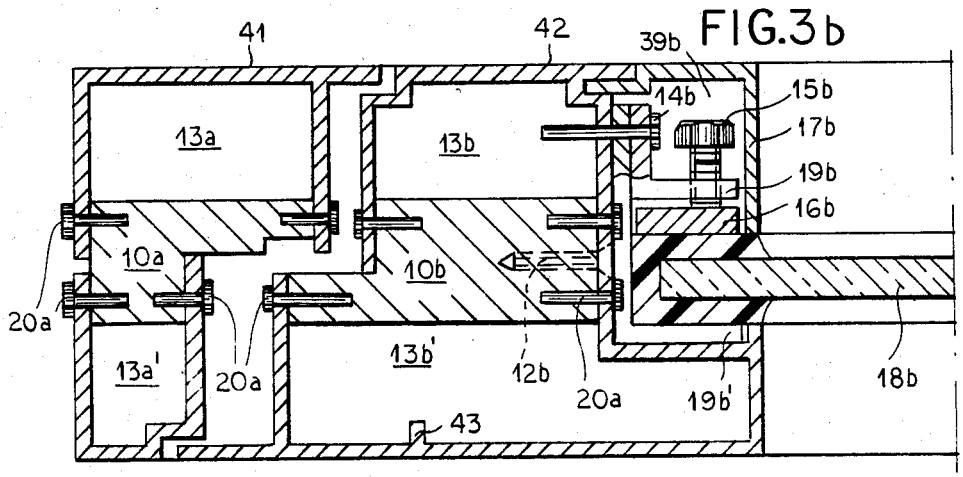

FIG. 3*b* shows a similar arrangement, but wherein the profiles forming the chambers 13*a*, 13*a'*, 13*b*, 13*b'* are held in place by means of screws 20*a*.

Figure 3C:
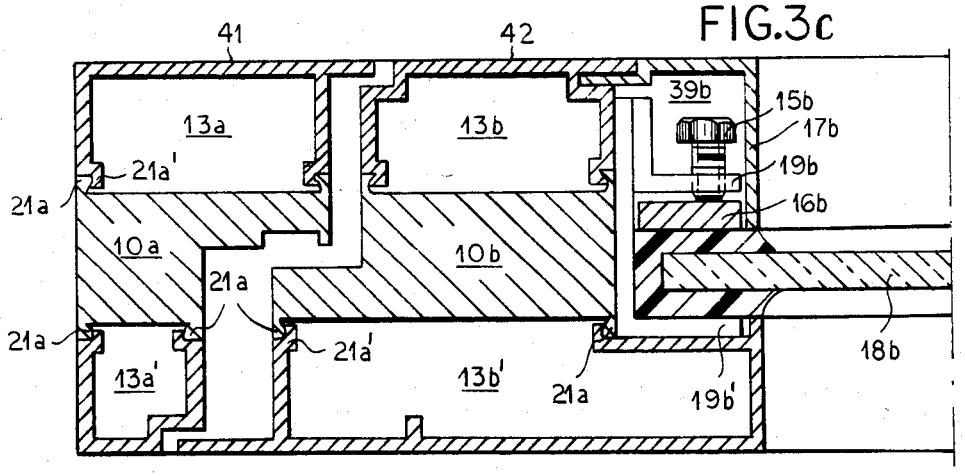

In FIG. 3*c* the core 10*a* if formed with lips 21*a* and the profiles forming the chambers 13*a*–13*b'* are provided with rabbets 21*a'* that mate with these lips 21*a*. Otherwise the structures shown in FIGS. 3*a*–3*c* are identical to those of 2*a*–2*c*, with like reference numerals being employed using postscripts a and b.

Figure 4A:
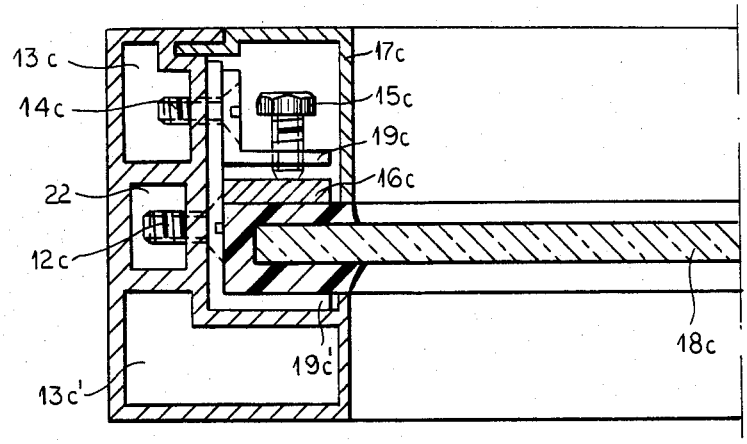
Figure 4B:
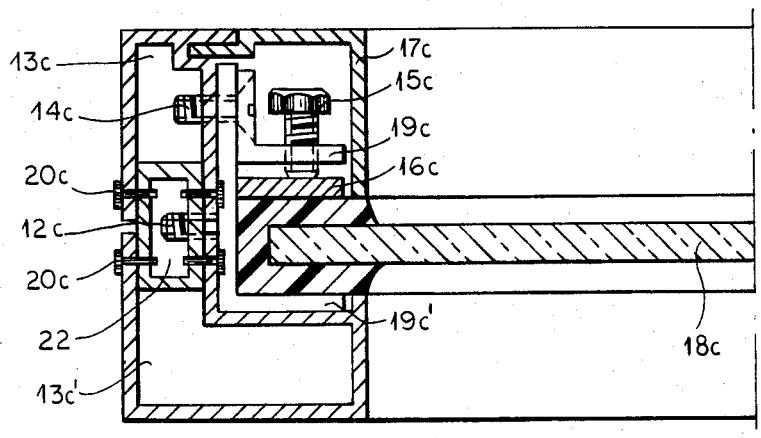
Figure 4C:
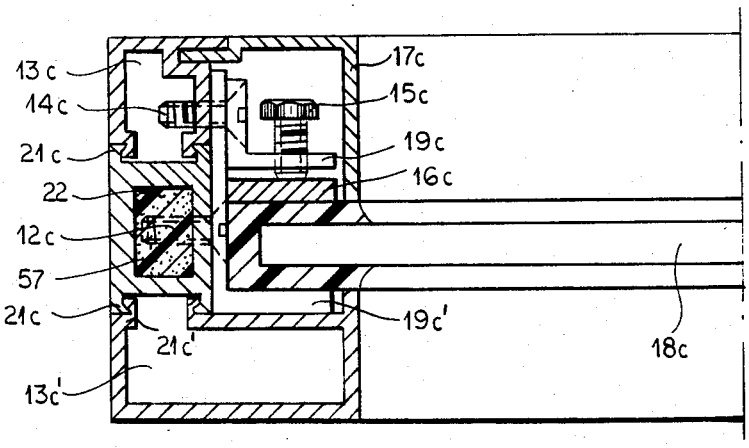

In FIGS. 4*a*–4*c* I have shown another, undivided type of framework wherein the core is hollow with a cavity 22. Otherwise the arrangement is substantially identical to that shown in FIGS. 2*a*–2*c*, like reference numerals bearing postscripts c being employed for functionally identical elements. It is also possible as shown in FIG. 4*c* to fill the core cavity 22 with a material 57 which generates a fire-extinguishing foam when heated.

Figure 5A:
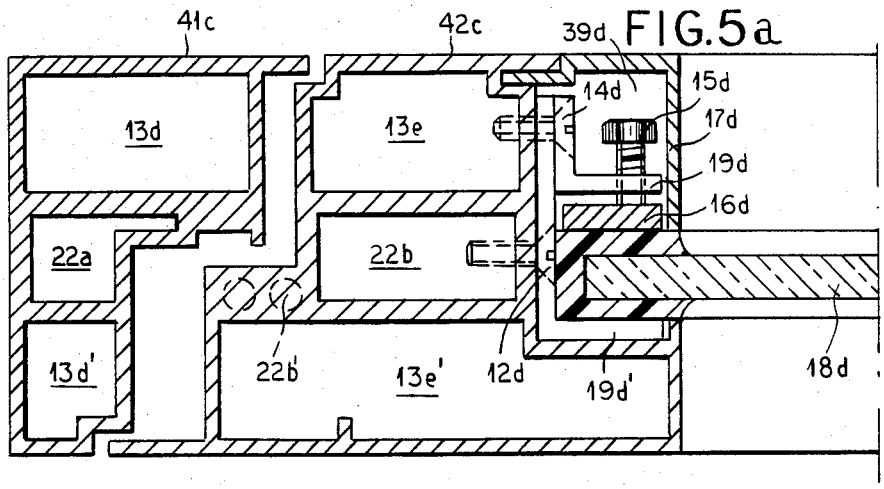
Figure 5B:
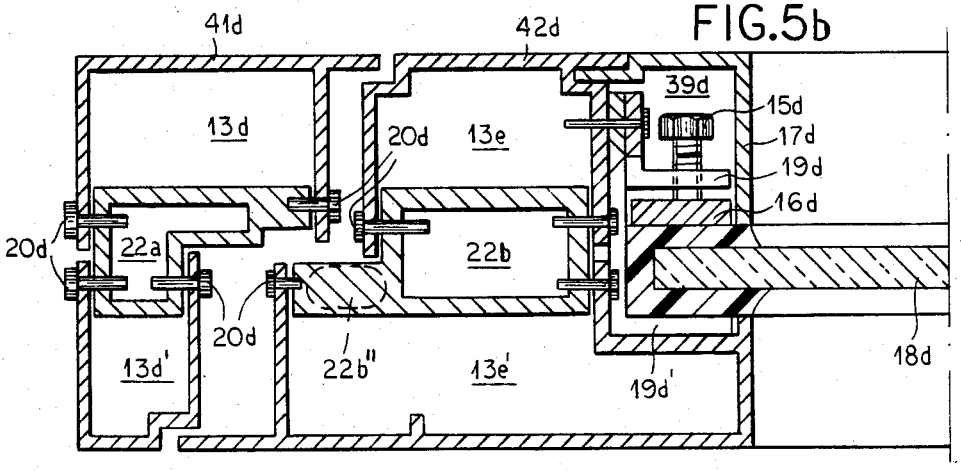
Figure 5C:
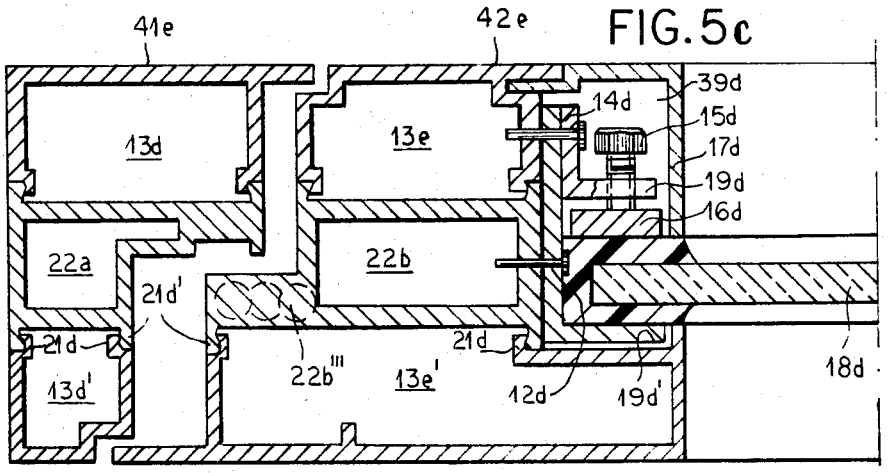

FIG. 5*a*–5*c* show structures substantially identical to those of FIGS. 3*a*–3*c*, the same reference numerals with postscripts c, d and e denoting functionally identical elements. However, the solid cores 10*a* and 10*b* are replaced by hollow cores having cavities 22*a* and 22*b* to reduce heat transfer through the assembly. In addition, cylindrical bores 22*b'*, an elliptical-section bore 22*b''*, or overlapping cylindrical bores 22*b'''* may be formed in the inner frame member 42*c*, 42*d* or 42*e* to lighten it and further reduce heat transfer through it.

Figure 6A:
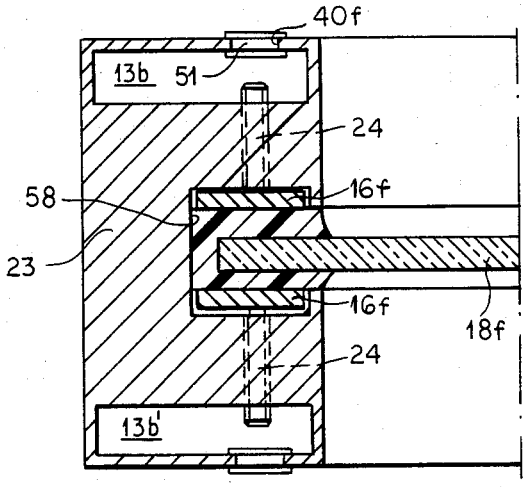
Figure 6B:
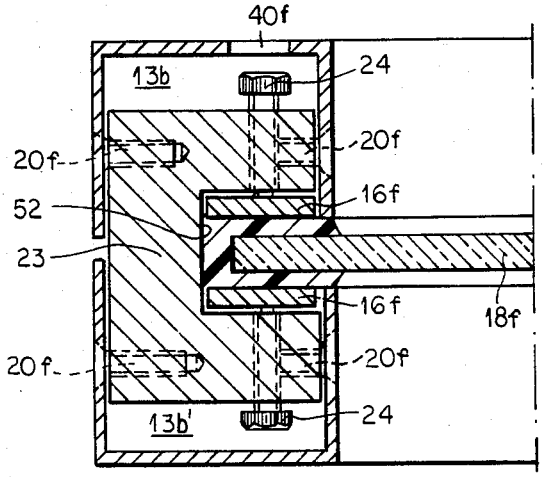
Figure 6C:
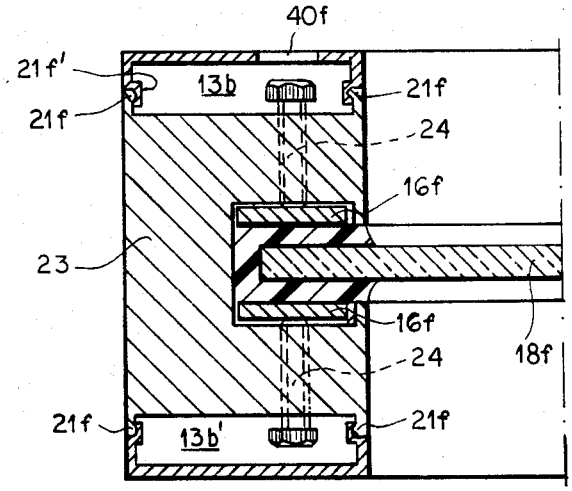

In FIGS. 6*a*–6*c* a solid C-section core 23 is flanked by two coextensive air spaces or chambers 13*b* and 13*b'*. Screws 24 threaded into the core 23 are accessible through holes 40*f*, provided with removable caps 51, to press retaining strips 16*f* against the panel 18*f* seated with its bead-enveloped edge in a notch 58 formed by the C-section core 23. FIG. 6*b* shows how screws 20*f* may be employed to hold the assembly together. FIG. 6*c* shows how interengaging formations 21*f*, 21*f'* may also be used to hold the assembly together.

Figure 7A:
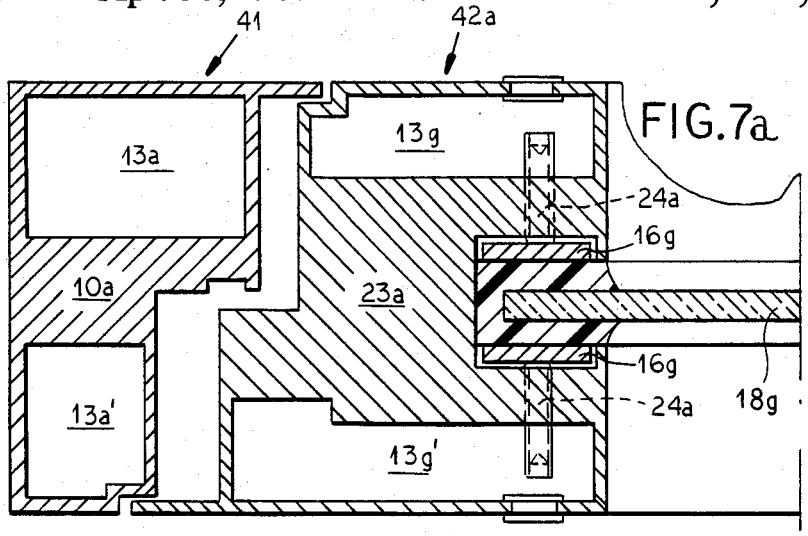
Figure 7B:
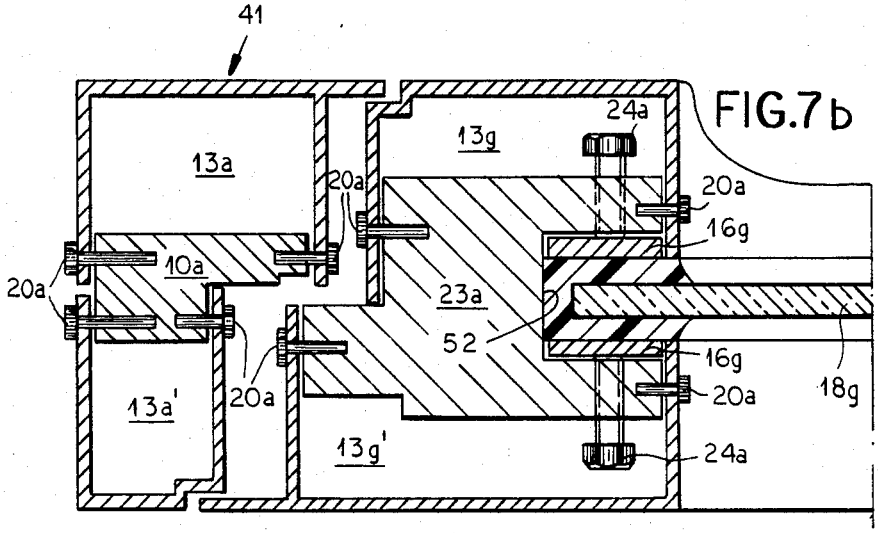
Figure 7C:
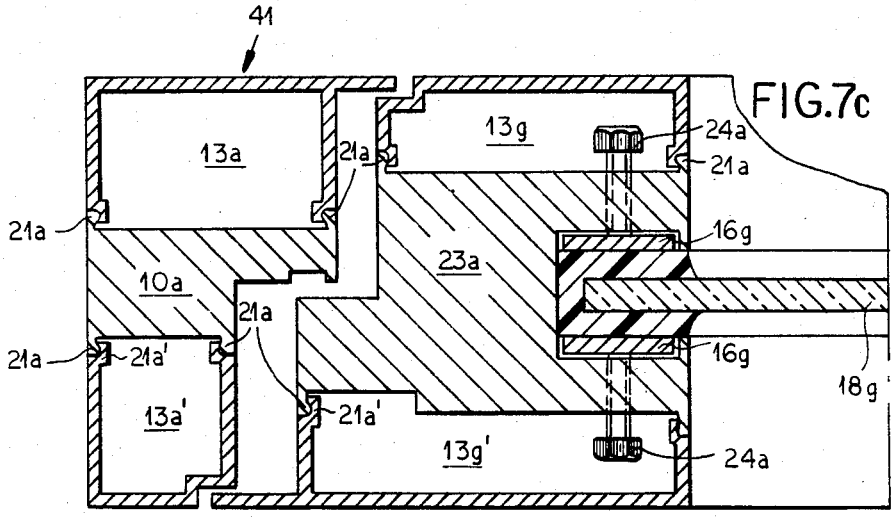

In FIGS. 7*a*–7*c* arrangements are shown having outer frame members 41 identical to those of FIGS. 3*a*–3*c*, respectively. Here the inner frame member 42*a*, however, has a massive core 23*a* flanked by chambers 13*g* and 13*g'* and is provided with screws 24*a* acting on retainer strips 16*g* substantially identical to those of FIGS. 6*a*–6*c*.

Once again FIG. 7*b* shows the use of screws 20*a* holding each frame member together and FIG. 7*c* shows the use of interfitting rabbets and ridges 21*a* and 21*a'*.

Figure 8A:
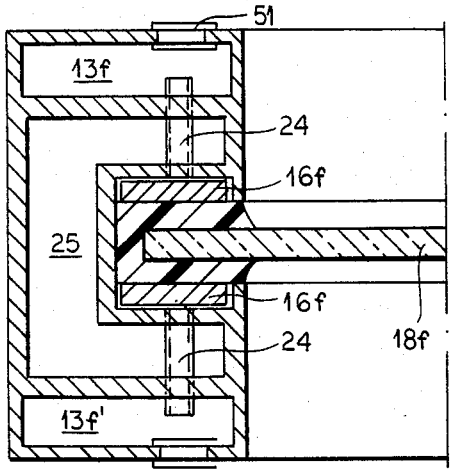
Figure 8B:
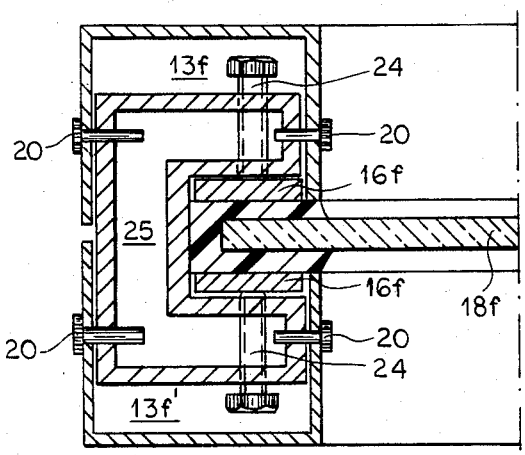
Figure 8C:
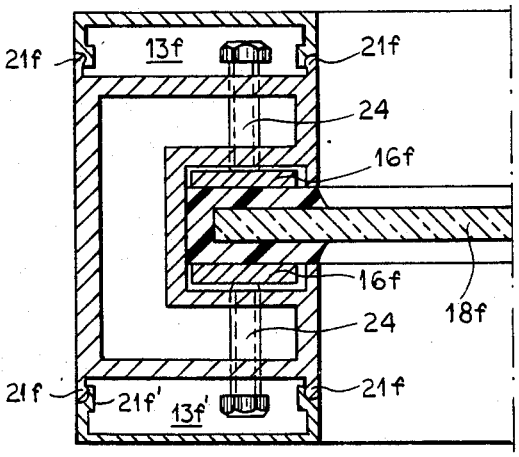

FIGS. 8*a*–8*c* show systems substantially identical to those of FIGS. 6*a*–6*c*, respectively, and identical reference numerals are used wherever applicable. Here, however, a hollow C-section core with a cavity 25 is employed. In all other respects the systems of FIGS. 8*a*–8*c* correspond to those of FIGS. 6*a*–6*c*.

Figure 9A:
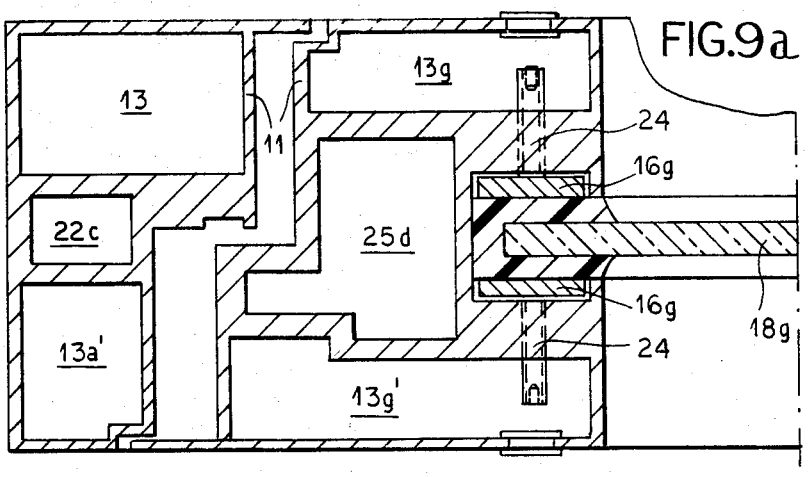
Figure 9B:
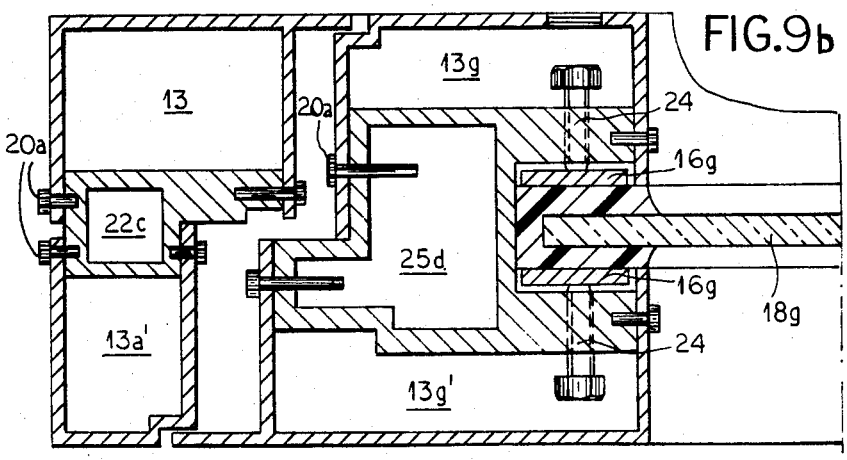
Figure 9C:
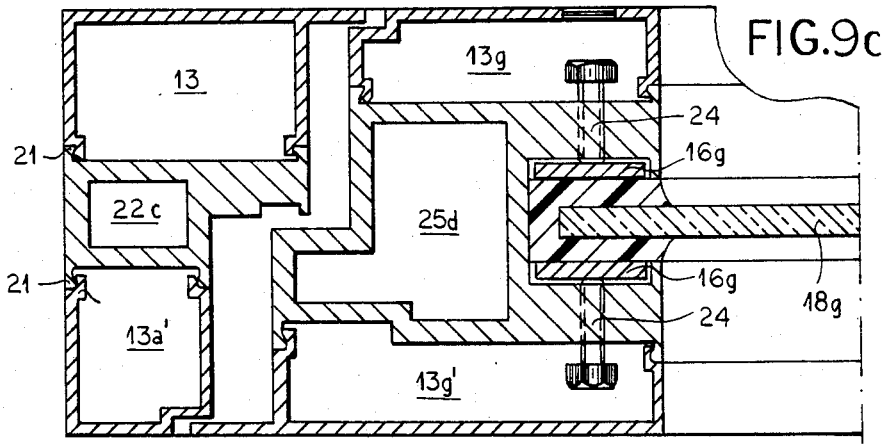

FIGS. 9*a*–9*c* show arrangements substantially identical to those of FIGS. 7*a*–7*c*, respectively, with like reference numerals applied to functionally identical elements. Here, however, hollow cores with cavities 22*c* and 25*d* are employed.

Figure 10A:
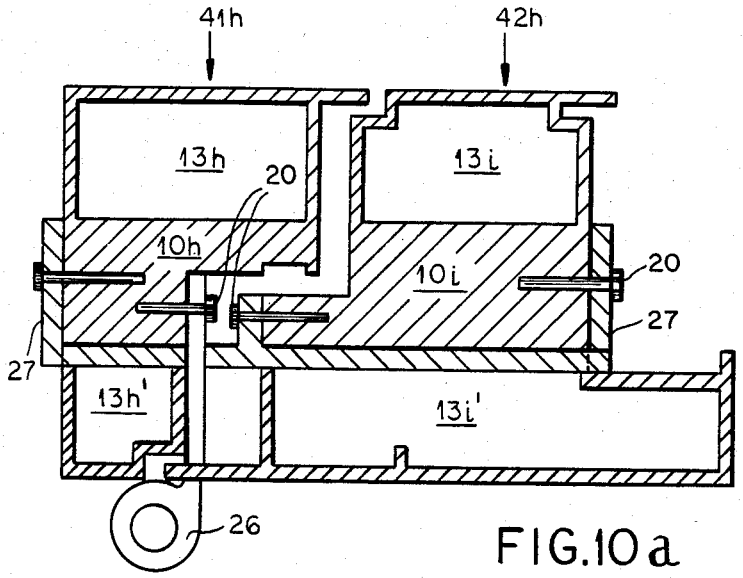

FIG. 10*a* shows an outer frame member 41*h* and an inner frame member 42*h* having respective solid cores 10*h* and 10*i* flanked by respective air spaces 13*h*, 13*h'*, 13*i* and 13*i'*. Here a fitting 27 of aluminum or steel is secured to the aluminum cores 10*h* and 10*i* for accommodating a bolt 26.

Figure 10B:
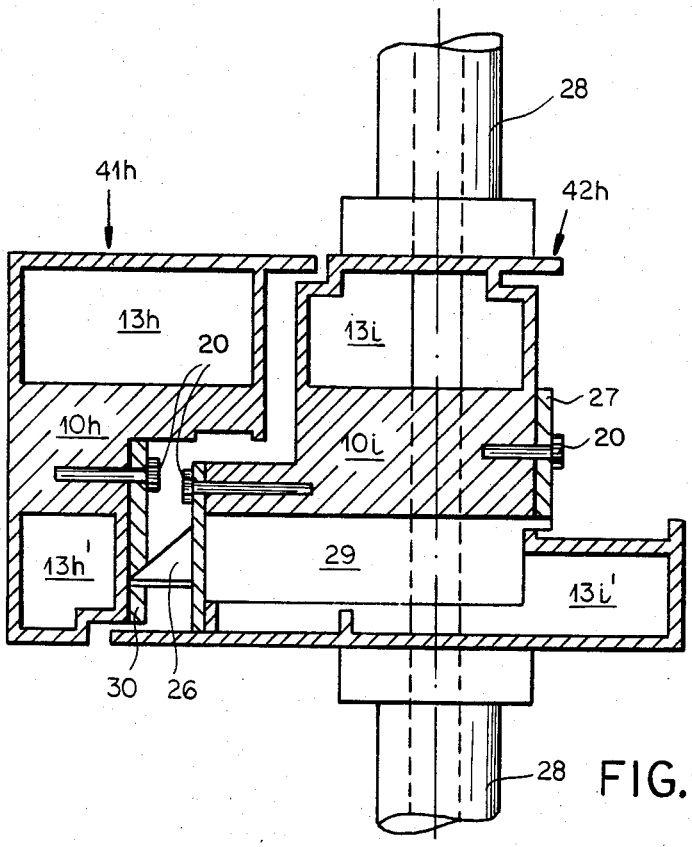

FIG. 10*b* shows an identical arrrangement used, however, with a lock 29 and a door-opening member 28. A coacting strike 30 is provided on the outer frame part 41*h*.

The strips 17*b* of FIGS. 3*a* and 3*b*, whose frame members are similar to those of FIGS. 10*a* and 10*b*, have been omitted in the latter Figures.

Figure 10C:
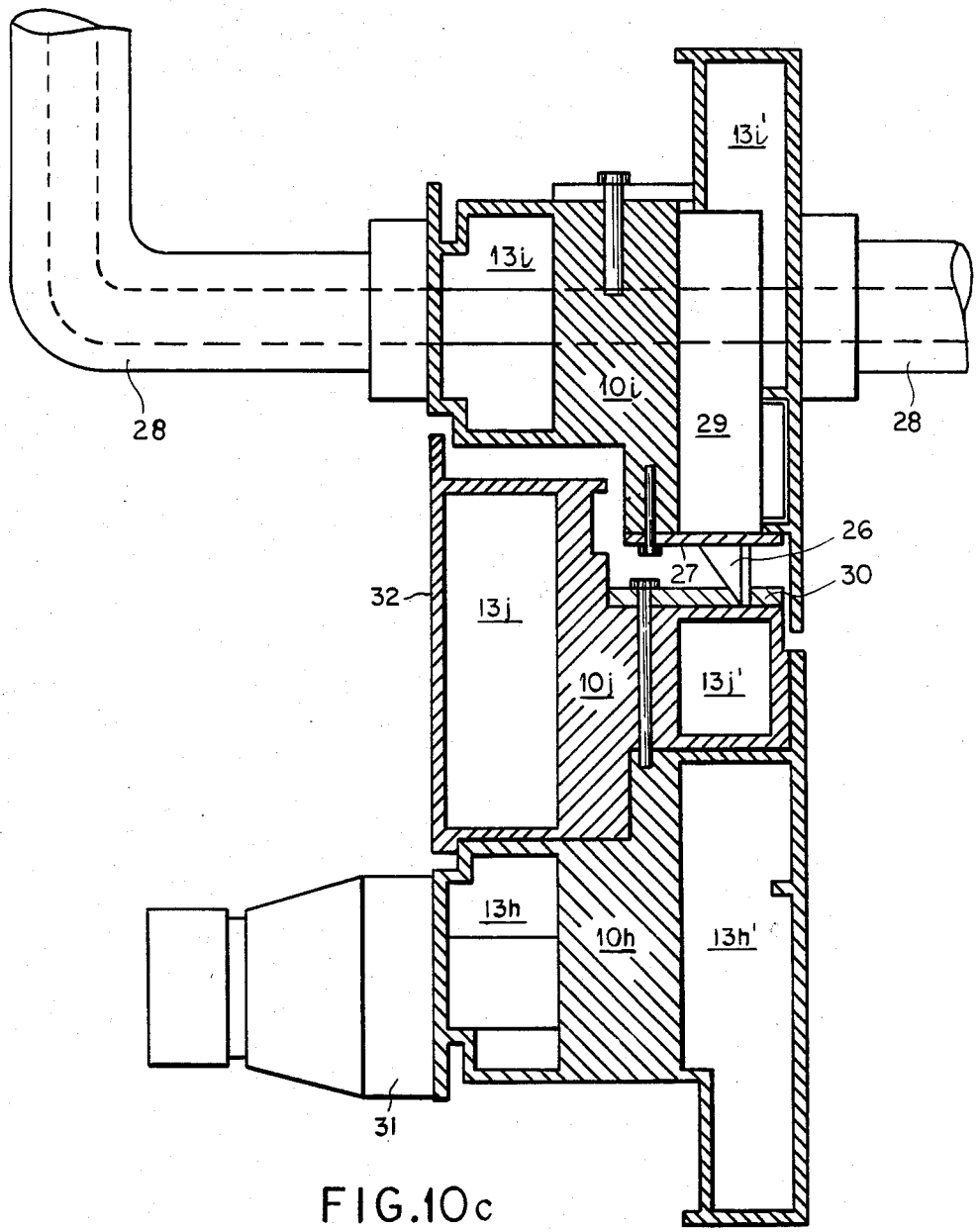

In FIG. 10*c* (which also lacks the counterparts of strips 17*b*) a similar arrangement is used, with identical reference numerals for functionally identical elements. Here, however, a central profile 32 is provided having a core 10*j* flanked by spaces 13*j* and 13*j'*. A latch mechanism 31 is bolted directly into the core 10*i*.

Figure 11A:
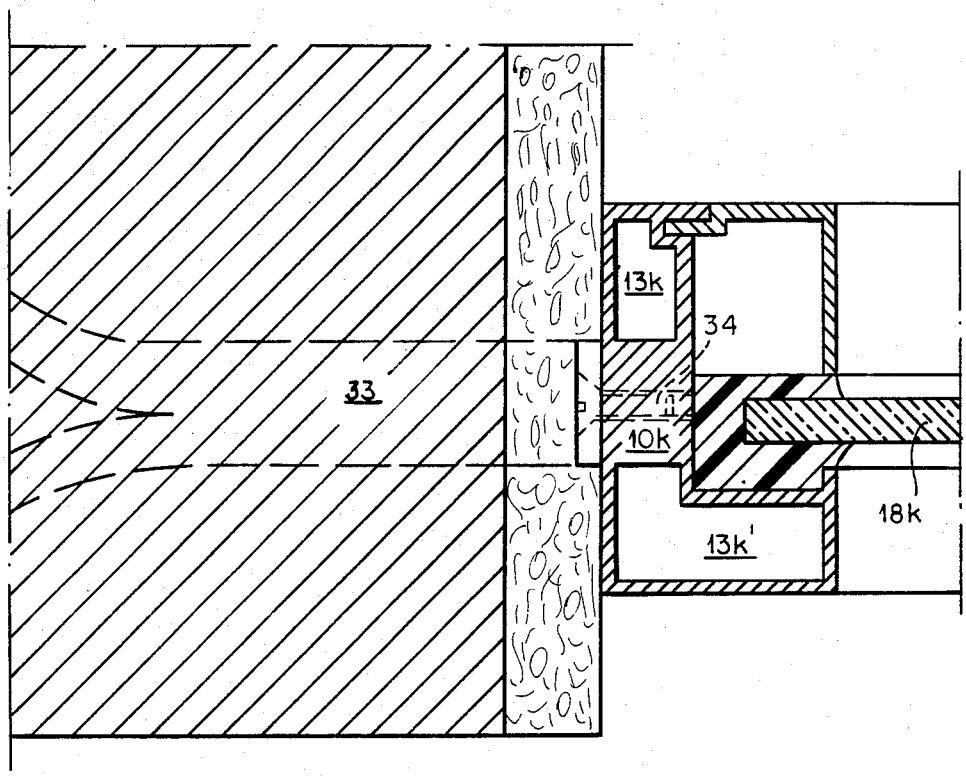
Figure 11B:
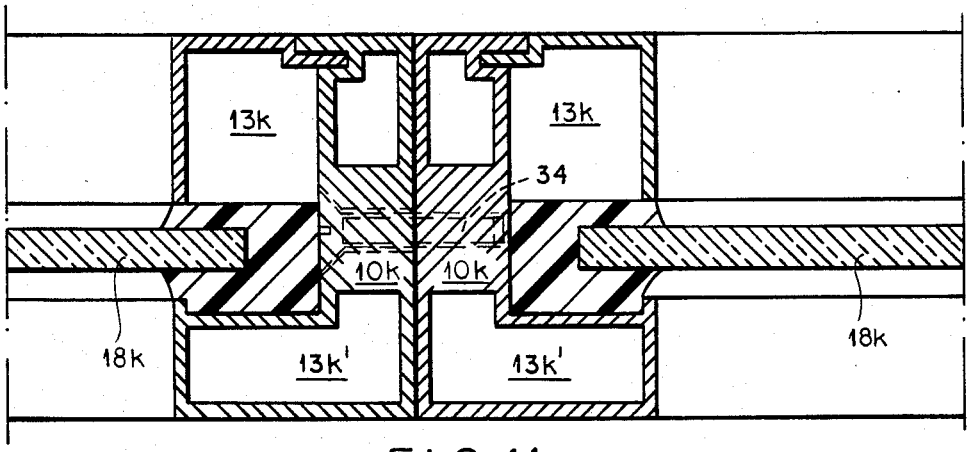

In FIGS. 11*a* and 11*b* I have shown framework legs each having a solid core 10*k* flanked by chambers 13*k* and 13*k'*. The glazing 18*k* is here of the fire-resistant type described in sections A1 and A2 of part one of German industrial standard (DIN)4102. A bolt 34 screwed directly into the core 10*k* secures it in place with respect to an anchor 33 set in a concrete wall as shown in FIG. 11*a* or to another core 10*k* as shown in FIG. 11*b*.

Figure 11C:
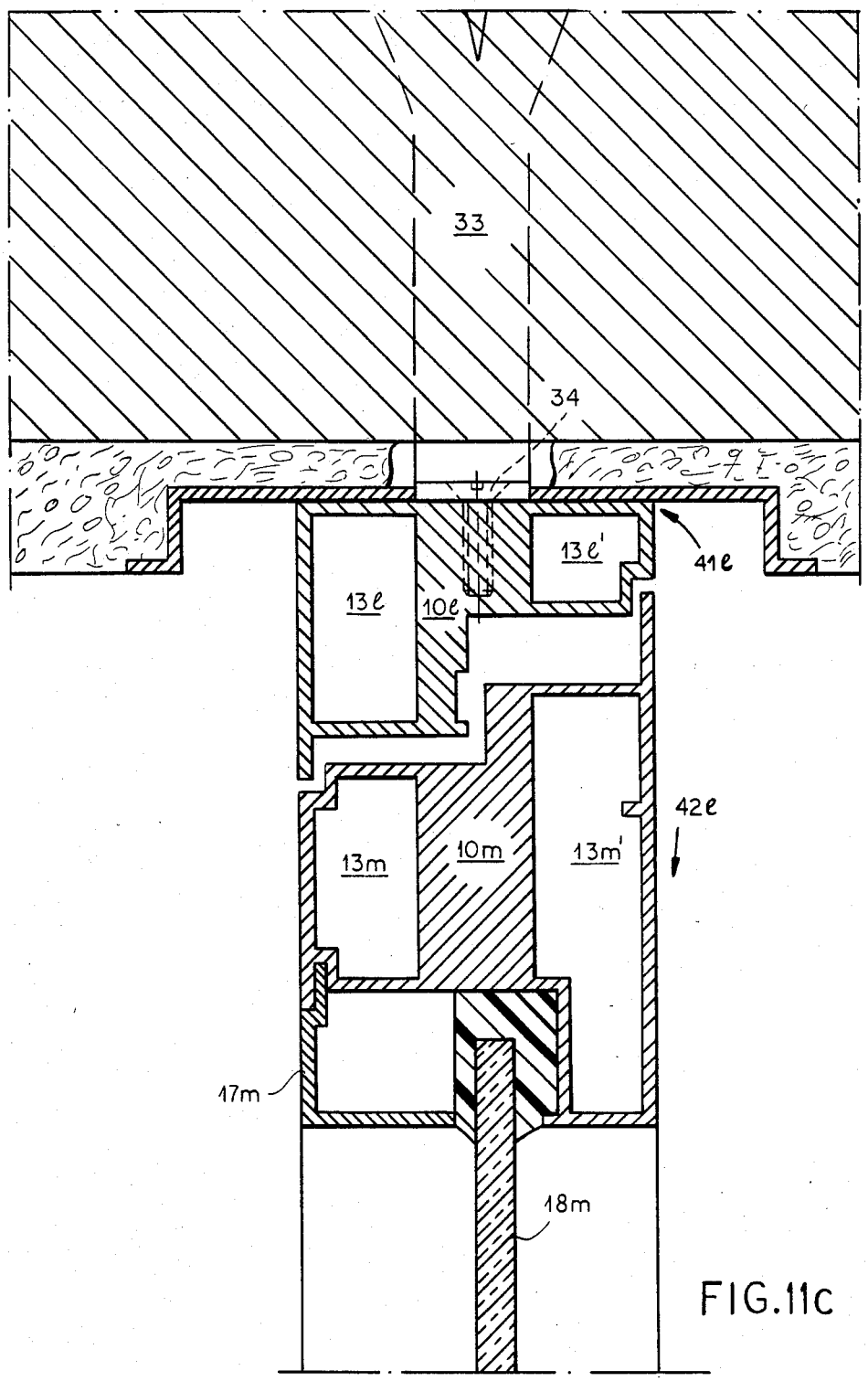

FIG. 11*c* shows profiles having solid cores 10*l* and 10*m* flanked by respective chambers 13*l*, 13*l'*, 13*m*, 13*m'*. Once again a screw 34 secures the outer profile 41*l* to an anchor 33 set in a concrete wall whereas the other profile 42*l* carries glazing 18*m* and a holding strip 17*m*.

Figure 12A:
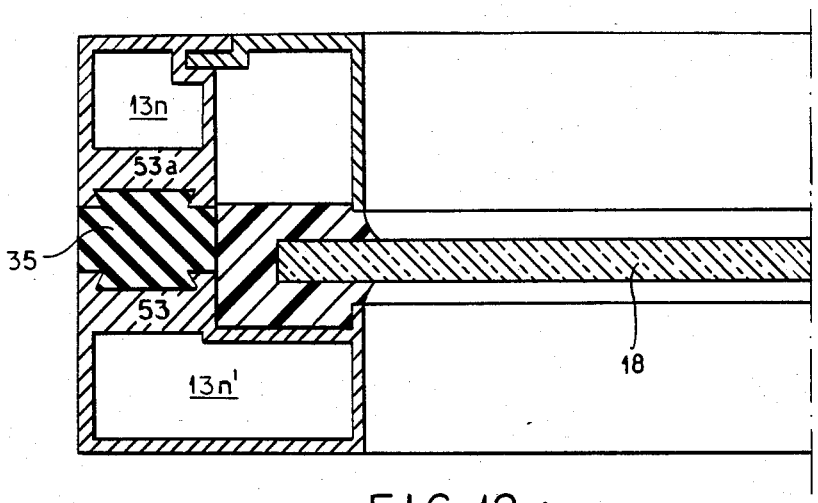
FIGS. 12*a*, 12*b*, 13*a*, 13*b*, 14*a*, 14*b*, 15*a*, 15*b*, 16, 17 and 18 are further cross-sectional views of portions of arrangements according to the instant invention.

FIG. 12*a* shows a somewhat different system wherein a framework leg has a core divided into two parts 53 and 53*a* separated by an insulating body or thermal break 35. Spaces 13*n*, 13*n'* flank the two-part core thus formed.

Figure 12B:
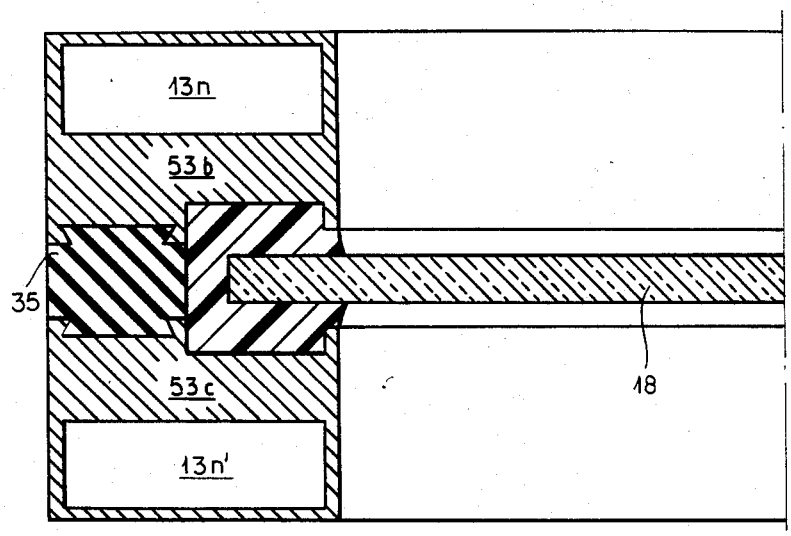

The system of FIG. 12*b* is substantially identical except that the solid core parts 53*c* and 53*b* flanking the thermal break 35 are substantially longer so as to form with this element 35 a portion of C-section.

Figure 13A:
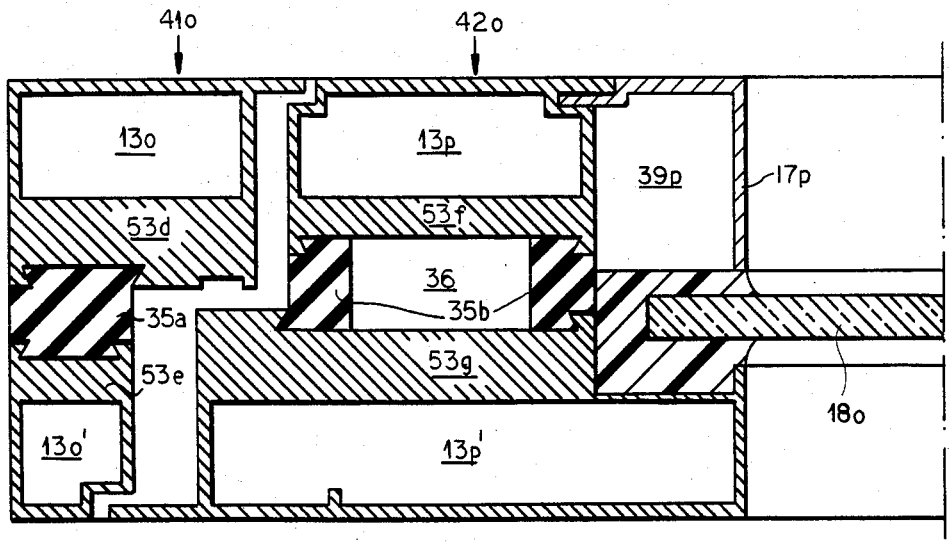

FIG. 13*a* shows an arrangement having an outer frame member 41*o* and an inner frame member 41*o*. The outer frame member 42*o* has a pair of solid core parts 53*d* and 53*e* flanking a thermal break 35*a* with chambers 13*o* and 13*o'* flanking the core thus formed. The inner frame part 42*o* has a pair of thermal breaks 35*b* flanking an empty space 36 and lying between solid core parts 53*f* and 53*g* in turn flanked by chambers 13*p* and 13*p'*. The glazing 18*o* is set in the frame part 42*o*.

Figure 13B:
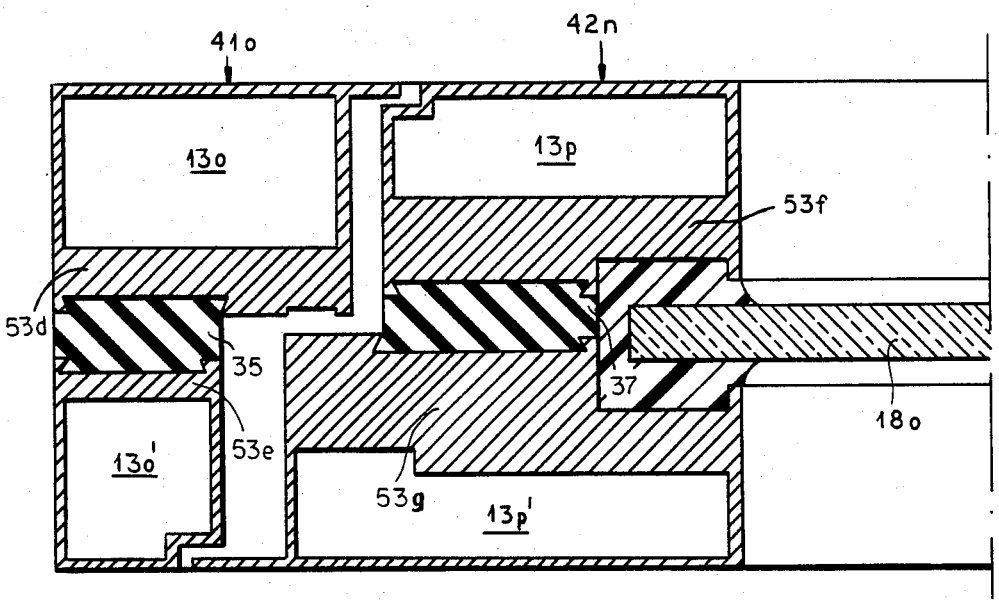

The system of FIG. 13*b* is substantially identical to that of FIG. 13*a* except that a single massive thermal break 37 is provided instead of the two breaks 35*b* and air space 36.

Figure 14A:
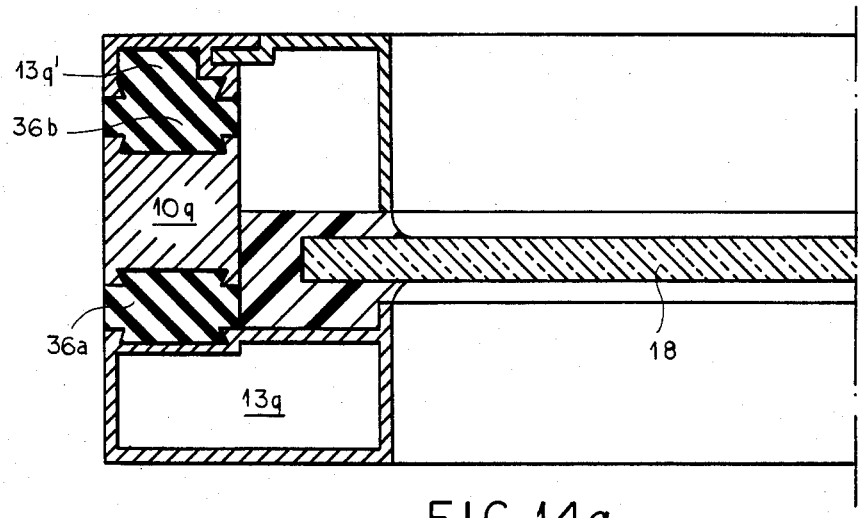

In FIG. 14*a* a solid core 10*q* is flanked by a pair of thermal breaks 36*a* and 36*b*. A chamber 13*q* adjoins the body 36*a* while body 36*b* fills the chamber 13*q'* which otherwise substantially corresponds to the empty chamber 13*n* of FIG. 12*a*.

Figure 14B:
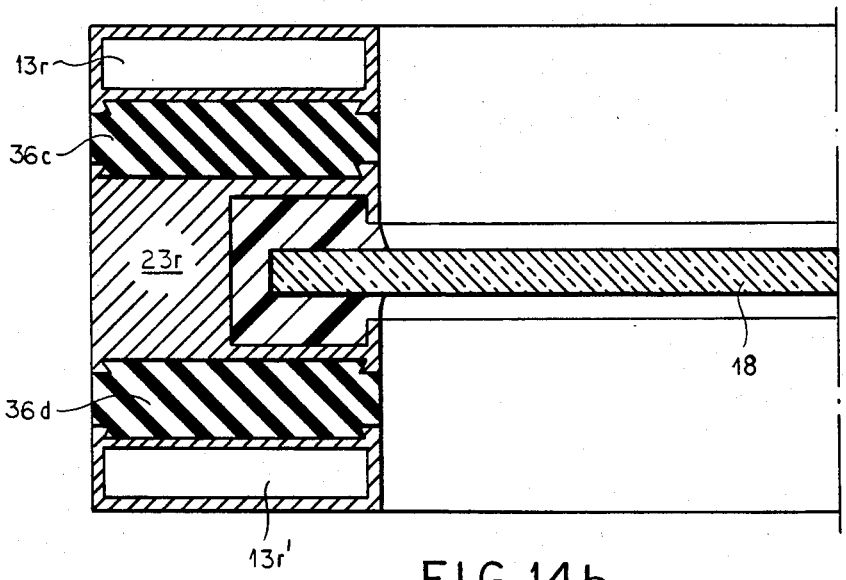

A solid core 23*r* of C-section is provided between a pair of thermal breaks 36*c* and 36*d* in FIG. 14*b*, in turn flanked by chambers 13*r* and 13*r'*.

Figure 15A:
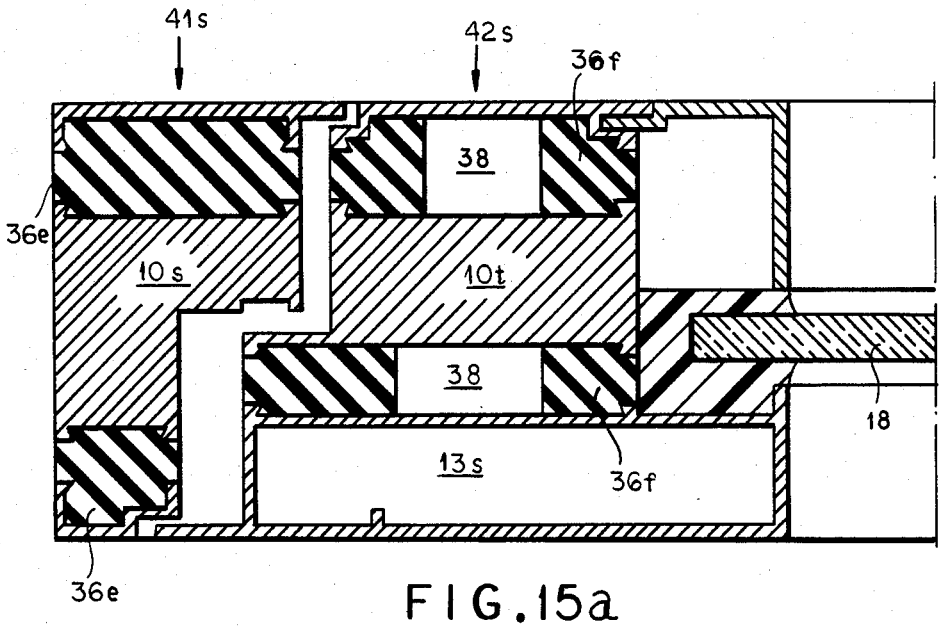

In FIG. 15*a* a pair of solid cores 10*s* and 10*t* of inner and outer frame parts 41*s* and 42*s* are provided. The core 10*s* is flanked by solid thermal breaks 36*e*. The core 10*t* is flanked by thermal breaks 36*f* defining empty spaces 38, of which one adjoins an air space or chamber 13*s*.

Figure 15B:
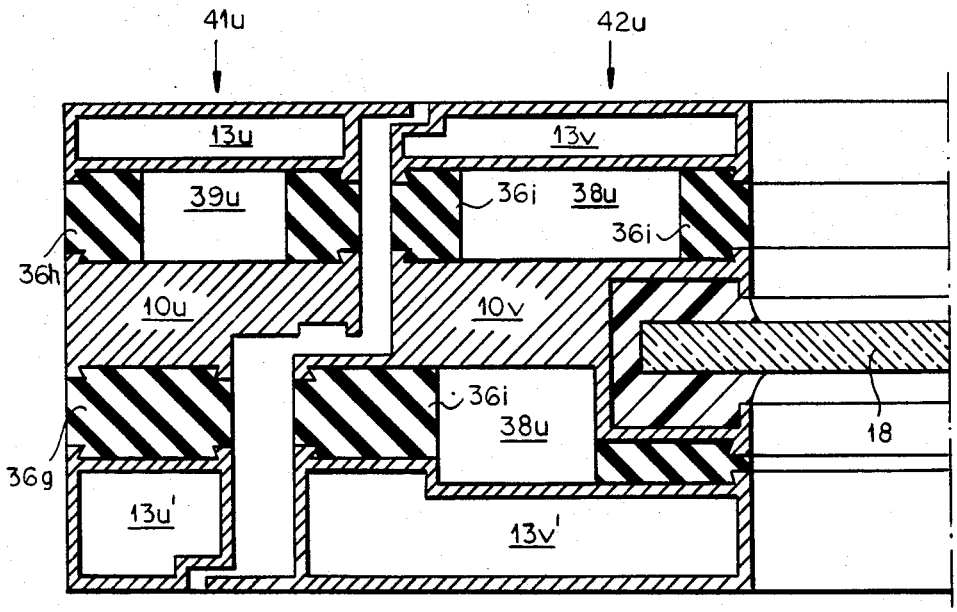

A similar arrangement is shown in FIG. 15*b*. Here an outer frame part 41*u* has a solid core part 10*u* flanked by thermal breaks 36*g* and 36*h*, the latter being duplicated on opposite side of a space 39*u*. In turn chambers 13*a* and 13*u'* flank the assembly 10*u*, 36*g*, 36*h*. The inner frame member 42*u* has a solid core 10*v* flanked by a pair of thermal breaks 36*i* defining spaces 38*u* and being in turn flanked by spaces 13*v* and 13*v'*.

Figure 16:
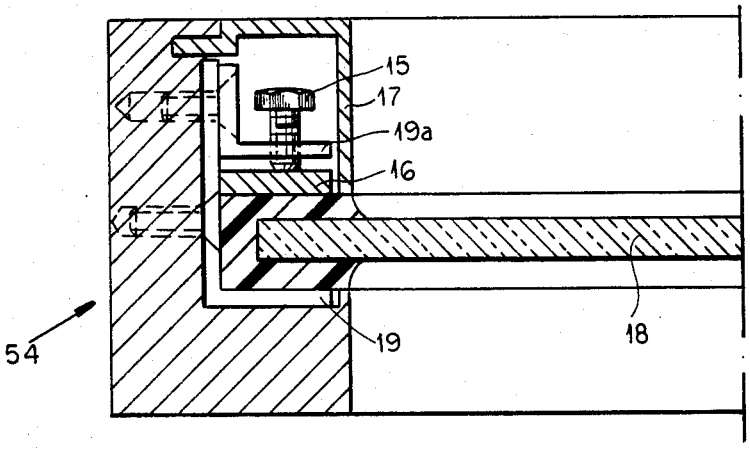
Figure 17:
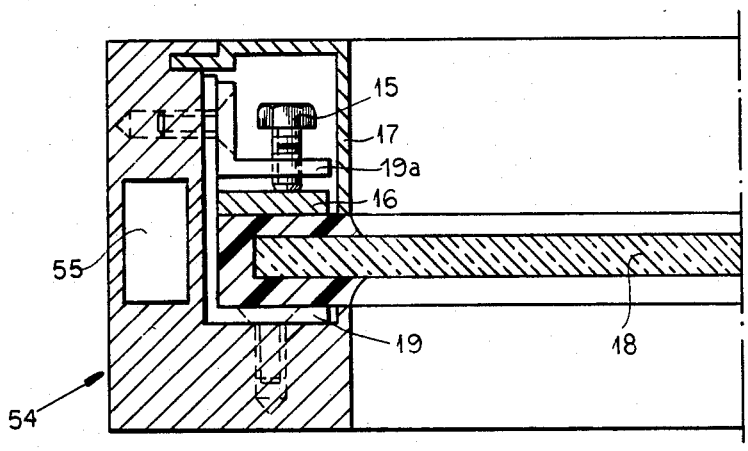
Figure 18:
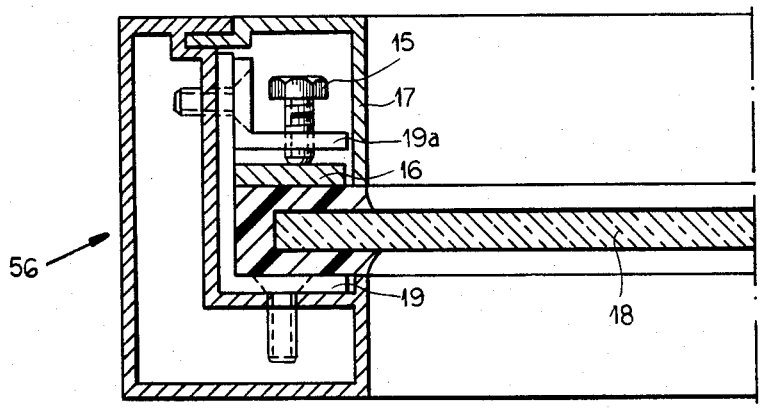

FIG. 16 shows a leg of a framework 54, solid except for an air space encompassed by a cover strip 17, provided with glass-retaining elements identical to those shown in FIGS. 2*a*–2*c*. FIG. 17 shows how an air space 55 can be provided in the center of the core 54 and FIG. 18 shows how the leg can be formed as a hollow framework 56.

Thus the system according to the instant invention allows a normally unsuitable material, aluminum, to be used in fireproof construction. This system is particularly applicable to window frames and the like since aluminum has the advantage of considerable strength and low corrosivity.

I claim:

1. A fireproof building element comprising:

a four-sided panel of nonflammable material with two planar surfaces; and a four-legged framework of nonflammable material surrounding said panel, each side of said panel being engaged by a leg of said framework having a rectangular cross-section divided in the plane of a surface of said panel into two frame portions together defining a recess accommodating an edge of said panel, said leg including at least one aluminum profile forming two opposite faces of said leg remote from said recess and parallel to said panel, at least one of said frame portions forming a chamber offset from said plane and separated from one of said faces by a sheet-aluminum wall having a thickness of at least one millimeter, said leg further having an aluminum core substantially in line with said panel and of greater thickness than the panel.

2. A building element as defined in claim 1 wherein said core is integral with said wall.

3. A building element as defined in claim 1 wherein said frame portions form at least two chambers flanking said core.

4. A building element as defined in claim 3 wherein said chambers are bounded by sheet-aluminum walls respectively forming said faces.

5. A building element as defined in claim 1 wherein said core is provided with a cavity.

6. A building element as defined in claim 5 wherein said cavity is filled with fire-extinguishing foam material.

7. A building element as defined in claim 1 wherein said edge is embedded in a bead of fireproof nonmetallic material received in a cutout of said core.

8. A fireproof building element comprising:

a four-sided panel of nonflammable material with two planar surfaces; and a four-legged framework of nonflammable material surrounding said panel, each side of said panel being engaged by a leg of said framework having a rectangular cross-section divided in the plane of a surface of said panel into two frame portions together defining a recess accommodating an edge of said panel, said leg including at least one aluminum profile forming two opposite faces of said leg remote from said recess and parallel to said panel, at least one of said frame portions forming a chamber offset from said plane and separated from one of said faces by a sheet-aluminum wall having a thickness of at least one millimeter, said leg further having a core with a cutout receiving said edge of said panel, said edge being embedded in a bead of fireproof nonmetallic material bracketed within said cutout by two aluminum strips, further comprising screw means threaded into said core for exerting clamping pressure upon said strips.

9. A fireproof building element comprising:

a four-sided panel of nonflammable material with two planar surfaces; and a four-legged framework of nonflammable material surrounding said panel, each side of said panel being engaged by a leg of said framework having a rectangular cross-section divided in the plane of a surface of said panel into two frame portions together defining a recess accommodating an edge of said panel, said leg including at least one aluminum profile forming two opposite faces of said leg remote from said recess and parallel to said panel, at least one of said frame portions forming a chamber offset from said plane and separated from one of said faces by a sheet-aluminum wall having a thickness of at least one millimeter, said leg further including two aluminum strips on opposite sides of said panel, said edge being embedded in a bead of fireproof nonmetallic material clamped between said strips.

10. A building element as defined in claim 9 wherein said leg is provided with screw means exerting clamping pressure upon one of said strips.

11. A building element as defined in claim 10 wherein said screw means is disposed in said chamber.

12. A building element as defined in claim 11 wherein said wall is provided with a closable opening giving access to said screw means.

13. A building element as defined in claim 11 wherein said wall has an extension forming part of said one of said faces, said extension being removable for giving access to said screw means.

14. A fireproof building element comprising:

a four-sided panel of nonflammable material with two planar surfaces; and a four-legged framework of nonflammable material surrounding said panel, each side of said panel being engaged by a leg of said framework having a rectangular cross-section divided in the plane of a surface of said panel into two frame portions together defining a recess accommodating an edge of said panel, said leg including at least one aluminum profile forming two opposite faces of said leg remote from said recess and parallel to said panel, at least one of said frame portions forming a chamber offset from said plane and separated from one of said faces by a sheet-aluminum wall having a thickness of at least one millimeter, said leg being subdivided into a laterally outer frame member and a laterally inner frame member swingable relatively to each other and provided with surfaces that are coplanar in a position of mutual alignment to define said faces.

15. A building element as defined in claim 14 wherein each of said frame members forms a pair of chambers bounded at said faces by sheet-aluminum walls having a thickness of at least one millimeter.

16. A building element as defined in claim 15 wherein said walls of each frame member are part of respective aluminum profiles bracketing an intervening core.

17. A fire-resistant building element comprising an elongate aluminum profile of four-sided cross-section attachable to a support at one side, said profile having a supporting part attachable to a supported element at the opposite side, said supporting part including an aluminum core terminating at said one side, a third side of said profile being bounded by an aluminum wall substantially thinner than said core spaced from said supporting part and forming with said core a closed chamber protecting said supporting part from fire approaching said third side whereby the connection between said support and said supported element is maintained intact for an extended period.

* * * * *